United States Patent [19]

Munch

[11] Patent Number: 4,823,692

[45] Date of Patent: Apr. 25, 1989

[54] ARRESTING SUPPORT FOR TYPE WHEELS

[75] Inventor: Helmut Munch, Hattersheim, Fed. Rep. of Germany

[73] Assignee: Francotyp-Postalia GmbH, Berlin, Fed. Rep. of Germany

[21] Appl. No.: 176,710

[22] Filed: Apr. 1, 1988

[30] Foreign Application Priority Data

Apr. 2, 1987 [DE] Fed. Rep. of Germany ..... 3711009

[51] Int. Cl.[4] ..... B41J 1/60

[52] U.S. Cl. ..... 101/110; 101/99

[58] Field of Search ..... 101/59, 75, 77, 79, 101/85, 86, 99–101, 106–108, 110, 95–97, 80–82, 87–89

[56] References Cited

U.S. PATENT DOCUMENTS 2,234,277 3/1941 Reinhold et al. ..... 101/110

4,084,507 4/1978 Sato ..... 101/110

*Primary Examiner*—Edgar S. Burr

*Assistant Examiner*—James Lisehora

*Attorney, Agent, or Firm*—Herbert L. Lerner; Laurence A. Greenberg

[57] ABSTRACT

An arresting support for type wheels of printing mechanisms in franking and postage machines and in portable postage and numbering devices includes a bearing shaft having pins disposed thereon. The bearing shaft has a blind bore formed therein extended in axial direction of the pins. An elastic insert is disposed in the blind bore. The bearing shaft also has a given number of stepped bores formed therein extending perpendicularly to the axial direction of the bearing shaft. Two resilient arresting spheres of different diameter are disposed in each respective stepped bore. The given number of type wheels are disposed next to each other on the bearing shaft. The spheres rest in cup-shaped indentations formed in the type wheels. The type wheels are retained in a selected position by the resilient arresting spheres and the type wheels are adjusted against pressure provided by the resilient arresting spheres.

5 Claims, 1 Drawing Sheet

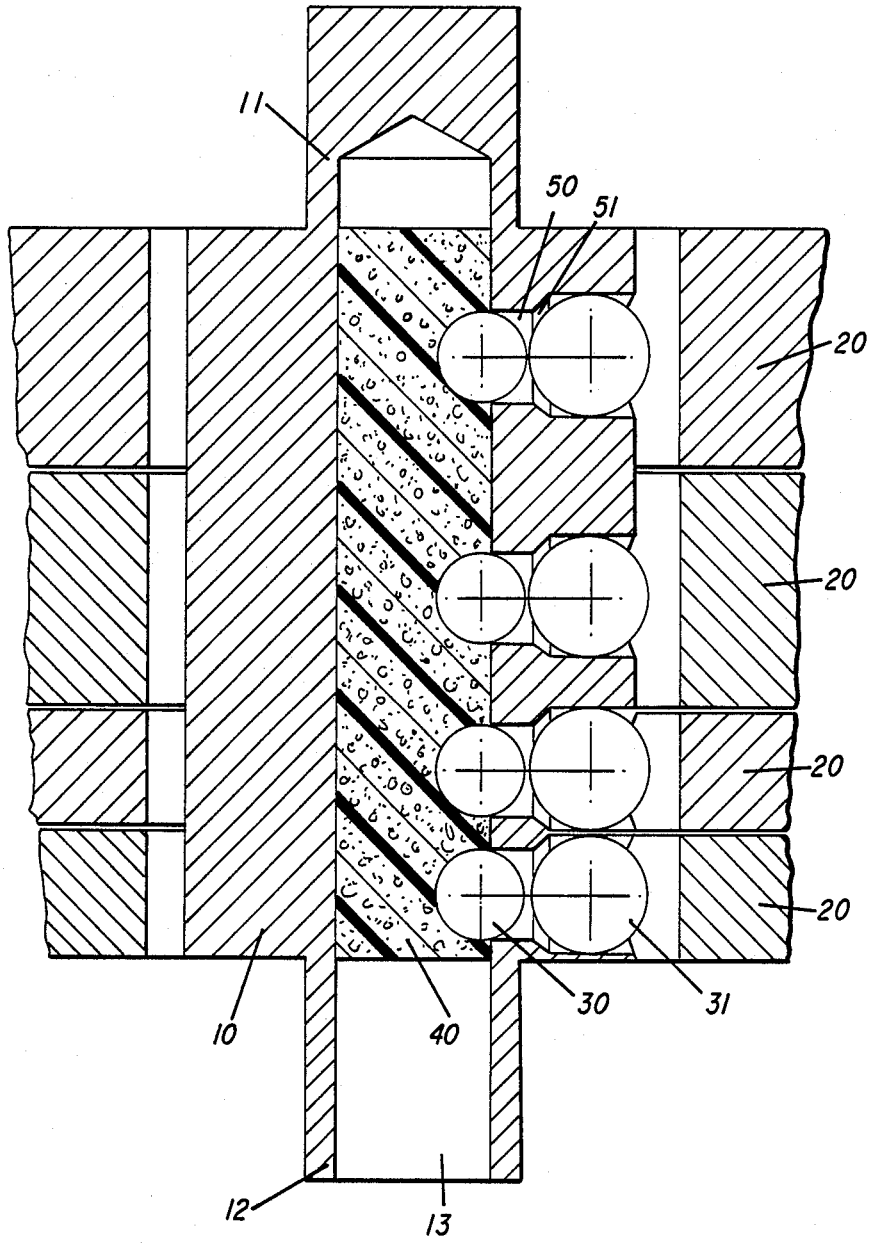
11
50
51
20
20
20
20
10
40
30
31
12
13

ARRESTING SUPPORT FOR TYPE WHEELS

The invention relates to an arresting support for type wheels of printing mechanisms in franking and postage machines as well as in portable postage and numbering devices, in which the type wheels are disposed next to each other on a bearing shaft provided with pins, the type wheels are retained in a selected position by resilient arresting spheres and the type wheels can be adjusted against the pressure of the arresting spheres.

In order to align type wheels for printing numbers having more than one numbers place or digit, for example, which is formed by a corresponding number of adjacent type wheels, it is known from German Patent DE-PS No. 30 43 683 to insert a coil spring into the opening of a support which serves as a shaft for the printing wheels. The base of each type wheel is made of plastic which guarantees elastic deformation when the type wheels are set.

It is also known from German Published, Non-Prosecuted Application DE-OS No. 31 40 982 to use plastic arresting shafts as arresting supports, having holes in which springs act on spheres in such a way that the spheres extend into recesses in the type wheels and act as arresting elements. The channels for the spheres are constricted ar the ends thereof so that the spheres cannot fall out.

These types of arresting supports for the alignment of type wheels are not commercially cost-effective with respect to the manufacture of tools, the assembly and the maintenance required, because of fatigue of some springs, for example. Furthermore, if comblike springs are used, the type wheels can generally only be adjusted in one direction.

It is accordingly an object of the invention to provide an arresting support for type wheels, which overcomes the hereinafore-mentioned disadvantages of the heretofore-known devices of this general type, which permits cost-effective production and which is furthermore maintenance-free and allows adjustment of the type wheels in two directions.

With the foregoing and other objects in view there is provided, in accordance with the invention, an arresting support for type wheels of printing mechanisms in franking and postage machines and in portable postage and numbering devices, comprising a bearing shaft having pins disposed thereon, the bearing shaft having a blind bore formed therein extended in axial direction of the pins, an elastic insert disposed in the blind bore, the bearing shaft having a given number of stepped bores formed therein extending perpendicularly to the axial direction of the bearing shaft, two resilient arresting spheres of different diameter disposed in each respective stepped bore, and the given number of type wheels disposed next to each other on the bearing shaft, the spheres resting in cup, ball-cup or socket-shaped indentations formed in the type wheels, the type wheels being retained in a selected position by the resilient arresting spheres, and the type wheels being adjusted against pressure provided by the resilient arresting spheres.

In accordance with another feature of the invention, the elastic insert is a rubber cord having a circular cross section.

In accordance with a further feature of the invention, the spheres include smaller and larger spheres with given diameters, and the stepped bores have means in the form of specific dimensions thereof for limiting movement of the larger spheres in axial direction of the stepped bores over a distance being small in comparison with or smaller than the given diameter of the larger spheres.

In accordance with an added feature of the invention, the type wheels include means for preventing the spheres from escaping.

In accordance with a concomitant feature of the invention, the bearing shaft has walls with inclinations each defining a transition between a smaller and a larger diameter of a stepped bore.

Other features which are considered as characteristic for the invention are set forth in the appended claims.

Although the invention is illustrated and described herein as embodied in an arresting support for type wheels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The FIGURE of the drawing is a fragmentary, diagrammatic, cross-sectional view of part of a printing mechanism.

Referring now to the single FIGURE of the drawing in detail, there is seen a bearing shaft 10 provided with cylindrical pins 11, 12. A blind bore 13 has been formed through one pin 12 in the bearing shaft 10 in axial direction of the pins 11, 12. Furthermore, the periphery of the bearing shaft 10 is provided with stepped bores 50 which are perpendicular to the axial direction and which correspond in number to the number of type wheels 20 to be installed.

During assembly of the printing mechanism, an elastic insert 40 is placed into the blind bore 13 in the bearing shaft 10. A rubber cord with a circular cross section is preferably used as elastic insert 40.

Spheres 30, 31 are inserted into the stepped bores 50. The stepped bores 50 are formed in such a way in relation to the diameters of the spheres 30, 31, that the larger spheres 31 abutting against the type wheels 20 can only be moved to a limited extent out of their position in the axial direction of the stepped bores 50, for example, typically 1/10 to $\frac{1}{8}$ of the diameter of the spheres. The freedom of movement of the smaller spheres 30 resting on the elastic insert 40 corresponds to that of the larger spheres. A step at the transition from the larger to the smaller diameter of each stepped bore 50 is in the form of an inclination 51 of the wall of the bore, the angles of which correspond the tangential angle of the contact point of the larger sphere 31.

After inserting two spheres 30, 31 into each one of the stepped bores 50, the associated type wheel 20 is pushed onto the bearing shaft 10, which at the same time prevents escape of the spheres 30, 31. The inner peripheries of the type wheels 20 have preferably ball cup or socket or cup-shaped indentations formed therein, which correspond in number at least to the number of different characters on the outer periphery thereof and in which the respectively associated larger spheres 31 rests.

The type wheels 20 can be arrestingly adjusted in two directions in this configuration. During adjustment, the spheres 30, 31 move away into the elastic insert 40 and then are again arrested in the next indentation of the type wheel 20 when it is moved. The material of the elastic insert 40 is selected in such a way that no lasting deformation can occur.

The printing mechanism illustrated in the drawing is suspended in a non-illustrated support device, which prevents the outer type wheels 20 from sliding off the bearing shaft 10.

The foregoing is a description corresponding in substance to German Application No. P 37 11 009.8, dated Apr. 2, 1987, the International priority of which is being claimed for the instant application, and which is hereby made part of this application. Any material discrepancies between the foregoing specification and the aforementioned corresponding German application are to be resolved in favor of the latter.

I claim:

1. Arresting support for type wheels of printing mechanisms in franking and postage machines and in portable postage and numbering devices, comprising a bearing shaft having pins disposed thereon, said bearing shaft having a blind bore formed therein extended in axial direction of said pins, an elastic insert disposed in said blind bore, said bearing shaft having a given number of stepped bores formed therein extending perpendicularly to the axial direction of said bearing shaft, two resilient arresting spheres of different diameter disposed in each respective stepped bore, and said given number of type wheels disposed next to each other on said bearing shaft, said spheres resting in cup-shaped indentations formed in said type wheels, said type wheels being retained in a selected position by said resilient arresting spheres, and said type wheels being adjusted against pressure provided by said resilient arresting spheres.

2. Arresting support according to claim 1, wherein said elastic insert is a rubber cord having a circular cross section.

3. Arresting support according to claim 1, wherein said spheres include smaller and larger spheres with given diameters, and said stepped bores have means in the form of specific dimensions thereof for limiting movement of said larger spheres in axial direction of said stepped bores over a distance being small in comparison with said given diameter of said larger spheres.

4. Arresting support according to claim 3, wherein said type wheels include means for preventing said spheres from escaping.

5. Arresting support according to claim 3, wherein said bearing shaft has walls with inclinations each defining a transition between a smaller and a larger diameter of a stepped bore.

* * * * *